US005735252A

United States Patent [19]

Blumenstock

[11] Patent Number: 5,735,252

[45] Date of Patent: Apr. 7, 1998

[54] METHOD FOR PNEUMATICALLY CHECKING THE OPERABILITY OF A TANK-VENTING SYSTEM

[75] Inventor: Andreas Blumenstock, Ludwigsburg, Germany

[73] Assignee: Robert Bosch GmbH, Stuttgart, Germany

[21] Appl. No.: 731,737

[22] Filed: Oct. 18, 1996

[30] Foreign Application Priority Data

Oct. 18, 1995 [DE] Germany ..... 195 38 775.9

[51] Int. Cl.[6] ..... F02M 37/04

[52] U.S. Cl. ..... 123/520; 123/198 D

[58] Field of Search ..... 123/198 D, 520, 123/521, 519, 518, 516

[56] References Cited

U.S. PATENT DOCUMENTS

| | | | |
|---|---|---|---|
| 5,353,771 | 10/1994 | Blumenstock | 123/198 D |
| 5,355,863 | 10/1994 | Yamanaka | 123/198 D |
| 5,398,661 | 3/1995 | Denz | 123/198 D |
| 5,448,980 | 9/1995 | Kawamura | 123/198 D |
| 5,460,141 | 10/1995 | Denz | 123/198 D |
| 5,463,998 | 11/1995 | Denz | 123/198 D |
| 5,501,198 | 3/1996 | Koyama | 123/198 D |
| 5,505,182 | 4/1996 | Denz | 123/198 D |
| 5,511,529 | 4/1996 | Blumenstock | 123/520 |

*Primary Examiner*—Carl S. Miller
*Attorney, Agent, or Firm*—Walter Ottesen

[57] ABSTRACT

The invention is directed to a method for pneumatically checking the operability of a tank-venting system having a tank made of a material such as plastic. The tank-venting system includes an adsorption filter having a venting line with a closeable shutoff valve mounted in the venting line. The adsorption filter is connected to the tank via a tank connecting line and a tank-venting valve. In the method, the tank-venting system is first charged with a first overpressure or underpressure which exceeds, by a predetermined value, a second overpressure or underpressure corresponding to a diagnostic overpressure or diagnostic underpressure with the tank-venting valve and the shutoff valve being closed. The first overpressure or underpressure is then removed after a pregiven time span has elapsed and an overpressure or underpressure decay gradient measurement is made only after an essentially constant diagnostic overpressure or diagnostic underpressure adjusts in the tank-venting system. A conclusion is then drawn as to the tightness of the tank-venting system based upon the decay gradient measurement.

8 Claims, 2 Drawing Sheets

METHOD FOR PNEUMATICALLY CHECKING THE OPERABILITY OF A TANK-VENTING SYSTEM

BACKGROUND OF THE INVENTION

According to the requirements of the California Environmental Authority (CARB), tank-venting systems of motor vehicles must be monitored with on-board means as to operability and especially with respect to the presence of leaks (on-board diagnostics). Leaks having a diameter down to 0.5 mm are to be detected.

A tank-venting system of a vehicle includes essentially a fuel tank, an adsorption filter and a venting line, which includes a closeable shutoff valve. The tank-venting system also includes a tank-venting valve which is connected to the adsorption filter via a venting line. The fuel tank is made of plastic for reasons of cost and to facilitate manufacture. The adsorption filter is connected to the fuel tank via a tank connecting line.

U.S. Pat. No. 5,349,935 discloses a method for pneumatically checking the operability of a tank-venting system wherein the tank-venting system is charged with a defined diagnostic overpressure when the tank-venting valve is closed and when the shutoff valve is closed. A conclusion is drawn as to the tightness of the tank-venting system based on an overpressure decay gradient measurement which is subsequently made. The overpressure decay gradient is then a measure for leakages of the tank-venting system.

As mentioned above, fuel tanks are today made of plastic primarily for reasons of cost, weight and formability. Such plastic fuel tanks have, however, the characteristic that they deform when subjected to a pressure charge. This deformation is caused by the creep or flow properties of the plastic, that is, by a time-dependent modulus of elasticity of the plastic. This deforming effect is dependent upon deterioration and temperature and influences the method for pneumatically checking the operability of a tank-venting system in a disadvantageous manner.

For example, the tank expands when subjected to the diagnostic overpressure whereby the tank volume increases and the overpressure is caused to slightly decay. In contrast, the volume of the tank becomes less when the tank is charged with a diagnostic underpressure so that the diagnostic underpressure decays slightly thereby. In both cases, an overpressure or underpressure decay gradient is caused in this manner which incorrectly indicates a leak which is not present and, in this way, can lead to an unwanted fault announcement.

In order to preclude such tank creep effects, the tank could be so reinforced that a creep effect of any significance no longer occurs. This however disadvantageously considerably increases the cost of manufacture of the fuel tank.

Furthermore, after charging the fuel tank with the diagnostic overpressure or underpressure, a delay can be introduced until the above-mentioned creep effect has decayed. The decay time is dependent upon temperature, deterioration and the like of the fuel tank. For this reason, this procedure has, however, the disadvantage that such a decay takes a long time, and furthermore, the overpressure or underpressure decay gradient caused by the creep effect can be distinguished only with difficulty from an overpressure decay gradient or an underpressure decay gradient which is caused by an actual leak.

SUMMARY OF THE INVENTION

It is an object of the invention to provide a method for pneumatically checking the operability of a tank-venting system of the kind described above which is so improved that the above-mentioned disadvantages are eliminated. It is also an object of the invention to provide such a method wherein the above-mentioned tank creep effect is eliminated and reliable conclusions can be drawn as to the possible presence of a leak in the tank-venting system.

The method of the invention is for pneumatically checking the operability of a tank-venting system having a tank made of a material such as plastic. The tank-venting system further includes an adsorption filter having a venting line with a closeable shutoff valve mounted in the venting line. The adsorption filter is connected to the tank via a tank connecting line and a tank-venting valve, which is connected to the adsorption filter via a valve line. The method includes the steps of: first charging the tank-venting system with a first overpressure or underpressure which exceeds, by a predetermined value, a second overpressure or underpressure corresponding to a diagnostic overpressure or diagnostic underpressure with the shutoff valve closed; removing the first overpressure or underpressure after a pregiven time span has elapsed; making an overpressure or underpressure decay gradient measurement only after an essentially constant diagnostic overpressure or diagnostic underpressure adjusts in the tank-venting system; and, drawing a conclusion as to the tightness of the tank-venting system based upon the decay gradient measurement.

It is especially advantageous that the tank is, for a short time, expanded (or shrunk) by being charged with an additional overpressure (or underpressure) which exceeds the diagnostic overpressure (or underpressure) by a predetermined value. With this expansion/shrinking to a higher pressure level, it is ensured that the tank no longer displays creep properties during the actual diagnostic overpressure or diagnostic underpressure and therefore no longer changes its geometric form so that the diagnostic overpressure or diagnostic underpressure remains constant during the diagnostic phase and an overpressure (or underpressure) decay gradient measurement permits a definite conclusion as to the presence of a leak.

An advantage is that a constructive reinforcement of the fuel tank is unnecessary.

It is, for example, especially advantageous that the amount of the overpressure or underpressure as well as the pregiven time span are predetermined in such a manner that the fuel tank is so deformed that the creep properties of the fuel tank, which influence the overpressure (or underpressure) decay gradient measurement, are eliminated.

The value of the additional overpressure (or underpressure) and the pregiven time span (that is, the expansion phase) are so selected that the greatest possible flow capability of the fuel tank to be checked is detected (that is, for example, the flow capability for a hot and deteriorated tank). In this way, the flow capabilities are covered for all peripheral conditions which are possible. Also, erroneous announcements during the pneumatic check of the operability of a tank-venting system are avoided in an advantageous manner, that is, those erroneous announcements which are caused by a tank which is inadequately strengthened.

Preferably, the pressure in the fuel tank is measured via a pressure sensor mounted in the fuel tank which measures the difference between the fuel tank pressure and the ambient pressure.

In the case of a tightness check by utilizing a diagnostic overpressure, the diagnostic overpressure as well as the additional overpressure can be built up via a pressurized-air supply unit and can again be removed, for example, by opening the shutoff valve.

By utilizing a diagnostic underpressure for checking tightness, the diagnostic underpressure as well as the additional underpressure can be built up by opening the tank-venting valve and simultaneously closing the shutoff valve. These pressures can be reduced by opening the shutoff valve, that is, the pressures can be removed in this manner.

The invention is also directed to pneumatically checking the tightness of a vessel such as a plastic vessel wherein the vessel is charged with a defined diagnostic overpressure or underpressure and a conclusion is drawn as to the tightness of the vessel based on an overpressure or underpressure decay gradient measurement.

With respect to the above, it is also a task of the invention to provide a method for checking tightness of any desired vessel which makes possible a rapid and reliable check as to tightness during manufacture of the vessel.

BRIEF DESCRIPTION OF THE DRAWINGS

The invention will now be described with reference to the drawings wherein.

DESCRIPTION OF THE PREFERRED EMBODIMENTS OF THE INVENTION

The basic idea of the present invention is to improve a method for pneumatically checking the operability of a tank-venting system in that the creep or deformation effect is eliminated by overexpanding or shrinking the tank. The creep or deformation effect in the fuel tank is caused by charging the fuel tank with a diagnostic overpressure or underpressure. This creep or deformation effect falsifies an overpressure or underpressure decay gradient measurement for determining a leak which may be present. The overexpansion or shrinkage of the tank is effected by charging the fuel tank with an additional overpressure or underpressure.

The method for pneumatically checking the operability of a tank-venting system is explained in the following in the context of utilizing a diagnostic underpressure. It is understood that the method can be carried out in a corresponding manner also by utilizing a diagnostic overpressure.

Figure 3:
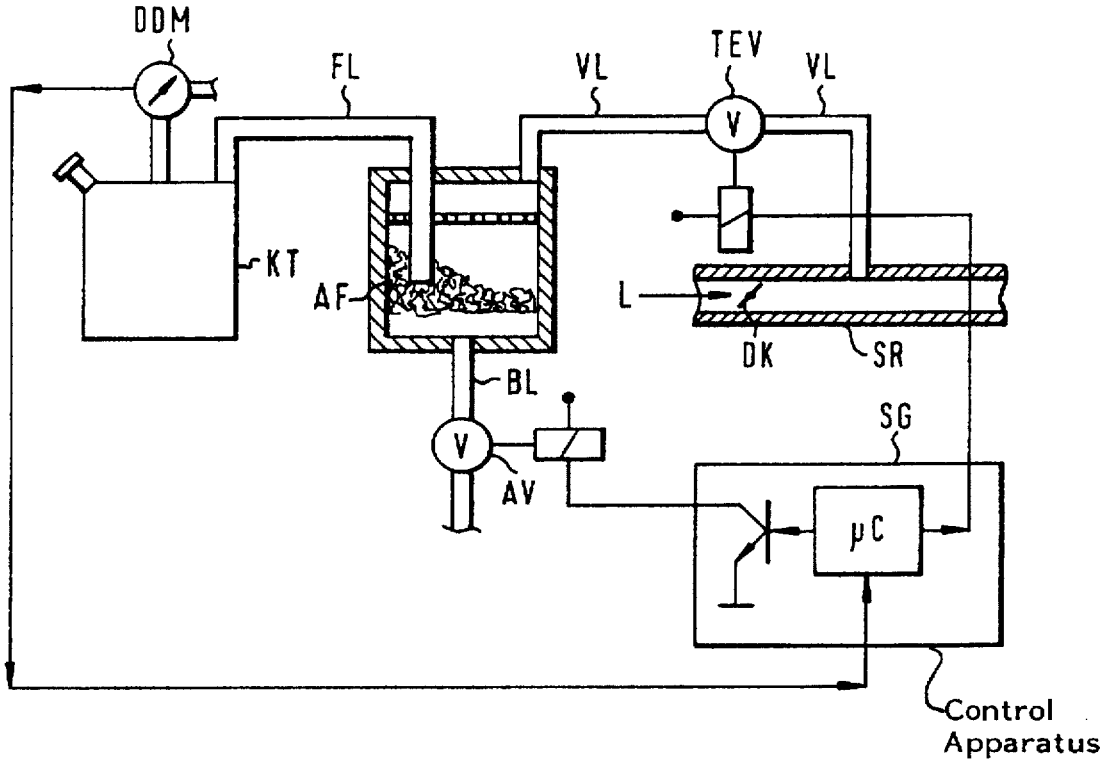

FIG. 3 schematically shows a tank-venting system known per se and including the following: a fuel tank KT, an adsorption filter AF and a tank-venting valve TEV. The tank-venting valve is mounted in a valve line VL which connects the adsorption filter AF to the intake pipe SR of an internal combustion engine (ICE). The valve line opens into the intake pipe SR downstream of the throttle flap DK as viewed in the flow direction L of the inducted air. In this way, it is possible to obtain a relatively high underpressure in the valve line VL in order to effectively scavenge the adsorption filter AF. The underpressure drops to a few hundred hPa when the throttle flap DK is substantially closed and for higher rpm of the engine.

The adsorption filter AF, in turn, is connected to the fuel tank KT via a filter line FL. When the fuel vaporizes in the fuel tank KT, the vaporizing fuel is adsorbed by active charcoal in the adsorption filter AF. In addition to the above-mentioned filter line FL and the valve line VL, a venting line BL opens into the adsorption filter AF. Air flows through the venting line BL when the adsorption filter AF is scavenged via the valve line having the tank-venting valve TEV. In this way, the active charcoal is regenerated. The active charcoal can again adsorb fuel during standstill phases of the engine or in the operating phases in which the tank-venting valve TEV is closed.

The tank-venting system shown in FIG. 3 further includes a difference pressure sensor DDM which measures the difference pressure in the tank relative to the atmospheric pressure and also includes a shutoff valve AV to controllably block the venting line BL. The shutoff valve AV as well as the tank-venting valve TEV can be opened and closed with the aid of signals which are outputted by a control apparatus SG.

In order to check such a tank-venting system pneumatically as to operability and especially tightness, the tank-venting system is charged with a defined diagnostic underpressure when the tank-venting valve TEV and the shutoff valve AV are closed. Thereafter, a conclusion is drawn as to the tightness of the tank-venting system with the aid of an underpressure decay gradient measurement undertaken with the aid of the difference pressure sensor DDM.

Figure 1:
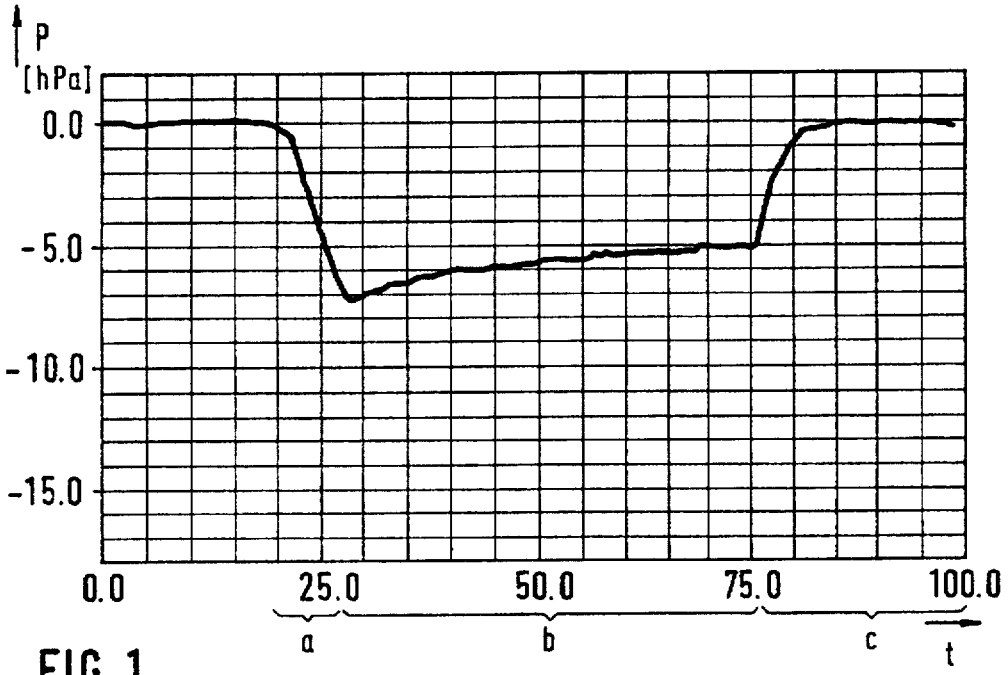
FIG. 1 is a graph showing a time-dependent trace of the pressure in a fuel tank which results from the creep properties of the fuel tank when subjected to a diagnostic underpressure.

FIG. 1 shows the time-dependent pressure trace of a fuel tank KT when charged with a diagnostic underpressure. As shown in FIG. 1, the tank KT is charged in a first time interval (a) with an underpressure. The tank KT is deformed because of this underpressure and a creep behavior of the tank KT takes place thereafter in the time interval (b). This creep behavior gives rise to an underpressure decay gradient which falsifies a pneumatic tightness check of the tank-venting system by determining the underpressure decay gradient which is caused by a possibly present leak. This is so because it is very difficult to distinguish between the underpressure decay gradient, which is caused by a possibly present leak, and the underpressure decay gradient, which is caused by the creep property of the fuel tank KT.

After checking the fuel tank KT as to tightness, a time interval (c) continues wherein the underpressure is again removed from the tank KT, for example, by opening the shutoff valve AV.

Figure 2:
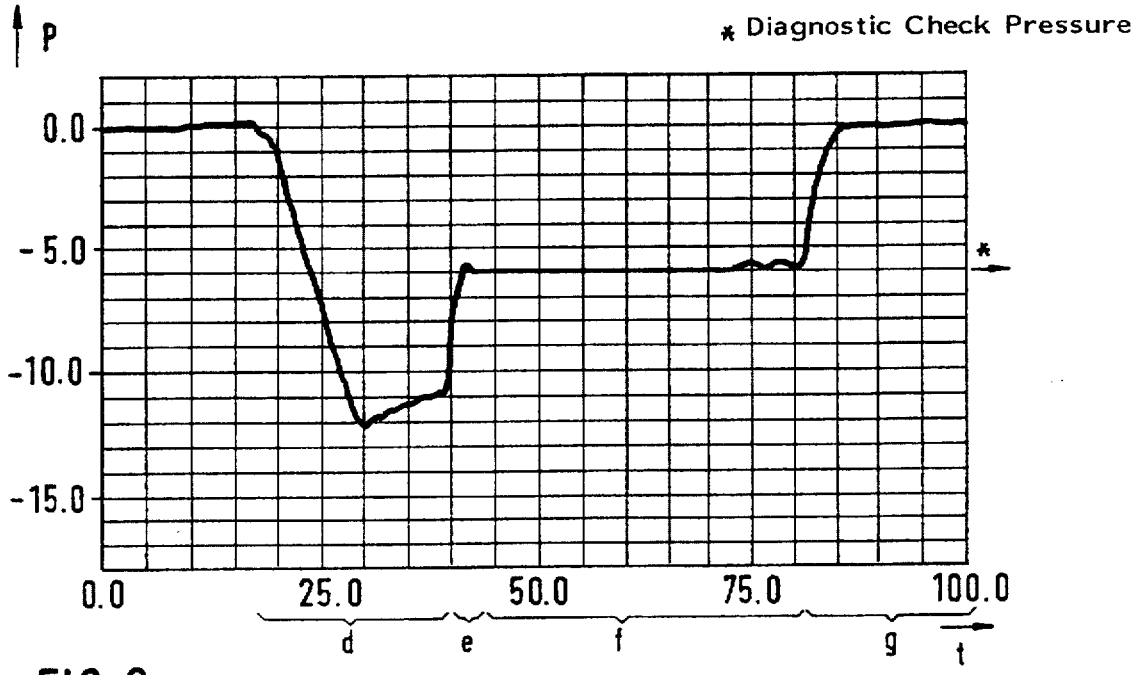
FIG. 2 is a graph showing a time-dependent pressure trace of a fuel tank subjected to an additional underpressure to compensate for the tank-creep effect; and, FIG. 3 is a schematic of a tank-venting system in which the method according to the invention is carried out.

The tank-venting system is now charged with an additional underpressure (see FIG. 2, time interval (d)) which exceeds the actual diagnostic underpressure by a predetermined value. In this way, the above-mentioned creep property of the plastic tank KT and the underpressure decay gradient caused thereby are eliminated and thereby a precise underpressure decay gradient measurement is possible for which the possibly present underpressure decay gradient is caused only by a leak. In this way, the fuel tank shrinks to a greater extent than with the charge of the actual diagnostic underpressure (diagnostic check pressure).

Thereafter, the additional underpressure is again removed after a pregiven time span (interval (e) in FIG. 2), for example, by opening the shutoff valve AV. After this pressure relief phase, the actual measuring phase continues (interval (e) in FIG. 2), that is, the time span in which the tank-venting system is checked as to operability (interval (f) in FIG. 2).

As shown in FIG. 2, this measuring phase (interval (f)) is characterized in that the fuel tank KT no longer exhibits any creep properties so that the diagnostic underpressure (diagnostic check pressure) assumes a constant value in the actual diagnostic phase as shown in FIG. 2 and the underpressure decay gradient measurement exhibits a gradient having the value 0 when no leak is present, or an underpressure decay gradient unequal to 0 is exhibited which is caused by a leak (not shown).

After the actual measuring phase, and in interval (g) (see FIG. 2), the diagnostic underpressure is again removed (that is, reduced) for example, via opening the shutoff valve AV.

The above-described method for pneumatically checking the operability of a tank-venting system is not limited to the check of a tank-venting system. Rather, it can also be used in an advantageous manner for a method for pneumatically checking the tightness of any desired vessel such as a plastic vessel wherein the vessel is charged with a defined diagnostic overpressure or underpressure and, because of an overpressure or underpressure decay gradient measurement undertaken thereafter, a conclusion as to tightness of the vessel can be drawn. In this case, the vessel is first charged with an additional overpressure or underpressure, which exceeds the diagnostic overpressure or underpressure by a predetermined value. Thereafter, this additional overpressure or underpressure is removed after a pregiven time span has elapsed and the overpressure or underpressure decay gradient measurement is then made when a constant diagnostic overpressure or underpressure has adjusted in the vessel.

This method makes possible a rapid and reliable check as to the tightness of the vessel during manufacture thereof.

In the case of the tightness check by utilizing a diagnostic overpressure, the diagnostic overpressure as well as the additional overpressure can be built up via a pressurized-air supply unit PAS and can be removed, for example, by opening the shutoff valve AV.

It is especially advantageous that one must not wait until the creep of the vessel (which is caused by a diagnostic overpressure or underpressure) has decayed. In this way, a shorter checking time and therefore a cost-effective manufacture of the vessel are provided.

With this method, a constant checking time is provided which is independent of the temperature and other parameters of the vessel. In this way, an improved time planning of the check and therefore an improved time planning of manufacture of a great number of pieces of this type of vessels is possible.

Furthermore, the magnitude of the creep effect must not be known because the additional overpressure or underpressure and the time span during which the vessel is charged with the additional overpressure or underpressure is so selected that the vessel is so deformed that any creep property is eliminated which could otherwise falsify the overpressure or underpressure decay gradient measurement.

It is understood that the foregoing description is that of the preferred embodiments of the invention and that various changes and modifications may be made thereto without departing from the spirit and scope of the invention as defined in the appended claims.

What is claimed is:

1. A method for pneumatically checking the operability of a tank-venting system having a tank made of a material such as plastic, the tank-venting system further includes an adsorption filter having a venting line with a closeable shutoff valve mounted in the venting line, the adsorption filter being connected to the tank via a tank connecting line, and a tank-venting valve, which is connected to the adsorption filter via a valve line, the method comprising the steps of:

first charging said tank-venting system with a first overpressure or underpressure which exceeds, by a predetermined value, a second overpressure or underpressure corresponding to a diagnostic overpressure or diagnostic underpressure with said shutoff valve closed;

removing said first overpressure or underpressure after a pregiven time span has elapsed;

making an overpressure or underpressure decay gradient measurement only after an essentially constant diagnostic overpressure or diagnostic underpressure adjusts in said tank-venting system; and, drawing a conclusion as to the tightness of said tank-venting system based upon said decay gradient measurement.

2. The method of claim 1, further comprising the step of predetermining the magnitude of said first overpressure or underpressure as well as said pregiven time span in such a manner that said fuel tank is so deformed that the change in geometric form of said fuel tank due to said diagnostic overpressure or underpressure, which influences the overpressure or underpressure decay gradient measurement, is eliminated.

3. The method of claim 1, further comprising the step of determining the pressure in said fuel tank with a difference pressure sensor mounted in said fuel tank and measuring the difference between the fuel tank pressure and the ambient pressure.

4. The method of claim 1, wherein, in the case of a tightness check utilizing a diagnostic overpressure, the diagnostic overpressure as well as said first overpressure is built up utilizing a pressurized air supply unit and is reduced by opening said shutoff valve.

5. The method of claim 1, in the case of a tightness check utilizing a diagnostic underpressure, the diagnostic underpressure as well as said first underpressure are built up by opening said tank-venting value while at the same time closing said shutoff valve and are removed by opening said shutoff valve.

6. A method for pneumatically checking the tightness of a vessel made of a material such as plastic, the method comprising the steps of:

first charging said vessel with a first overpressure or underpressure which exceeds, by a predetermined value, a second overpressure or underpressure corresponding to a diagnostic overpressure or diagnostic underpressure;

removing said first overpressure or underpressure after a pregiven time span has elapsed;

making an overpressure or underpressure decay gradient measurement only after an essentially constant diagnostic overpressure or diagnostic underpressure adjusts in said vessel; and, drawing a conclusion as to the tightness of said tank-venting system based upon said decay gradient measurement.

7. The method of claim 6, further comprising the step of selecting the magnitude of said first overpressure or underpressure as well as said pregiven time span in such a manner that said vessel is so deformed that the change in geometric form of said vessel due to said diagnostic overpressure or underpressure, which influences the overpressure or underpressure decay gradient measurement, is eliminated.

8. The method of claim 6, further comprising the step of determining the pressure in said vessel with a difference pressure sensor mounted in said vessel and measuring the difference between the vessel pressure and the ambient pressure.

* * * * *